United States Patent [19]

Berger

[11] Patent Number: 4,931,607

[45] Date of Patent: Jun. 5, 1990

[54] PUSHBUTTON SWITCH

[75] Inventor: Fritz Berger, Oberbuchsiten, Switzerland

[73] Assignee: Elektro-Apparatebau Olten AG, Olten, Switzerland

[21] Appl. No.: 301,544

[22] Filed: Jan. 24, 1989

[30] Foreign Application Priority Data

Feb. 4, 1988 [CH] Switzerland ..... 397/88

[51] Int. Cl.[5] ..... H01H 3/42; H01H 13/56

[52] U.S. Cl. ..... 200/524; 200/523

[58] Field of Search ..... 200/523, 524, 525, 573

[56] References Cited

U.S. PATENT DOCUMENTS

| | | | |
|---|---|---|---|
| 3,766,346 | 10/1973 | Alexander | 200/524 |
| 4,242,544 | 12/1980 | Schweiter | 200/5 E |
| 4,242,545 | 12/1980 | Schweitzer | 200/5 E |
| 4,368,368 | 1/1983 | Rossenberger | 200/524 |
| 4,404,444 | 9/1983 | Kinney et al. | 200/524 |

FOREIGN PATENT DOCUMENTS 595687 2/1978 Switzerland .

*Primary Examiner*—Henry J. Recla

*Assistant Examiner*—Glenn T. Barrett

*Attorney, Agent, or Firm*—Peter K. Kontler

[57] ABSTRACT

A pushbutton switch which is convertible to operate as a momentary switch or as a latching switch has a tubular housing for a reciprocable plunger which is movable between an extended and a depressed position and is biased to extended position. The plunger carries a cam which is tracked by a pendulum-type follower coupled to a leaf spring which is shiftable in the housing between a first position and a second position. When the leaf spring is held in the first position, the follower cooperates with the cam to ensure that the switch acts as a momentary switch, namely the plunger is free to reassume its extended position as soon as the force which has caused depression of the plunger is terminated or relaxed. If the leaf spring is shifted to the second position, the follower holds the plunger and the cam in or close to the depressed position. It is then necessary to depress the plunger a second time before the plunger can return to the extended position. The leaf spring is maintained in frictional engagement with the housing and can be designed to remain in the second position so that, once the switch is converted into a latching switch, it can act only as a latching switch.

14 Claims, 2 Drawing Sheets

FIG. 2A
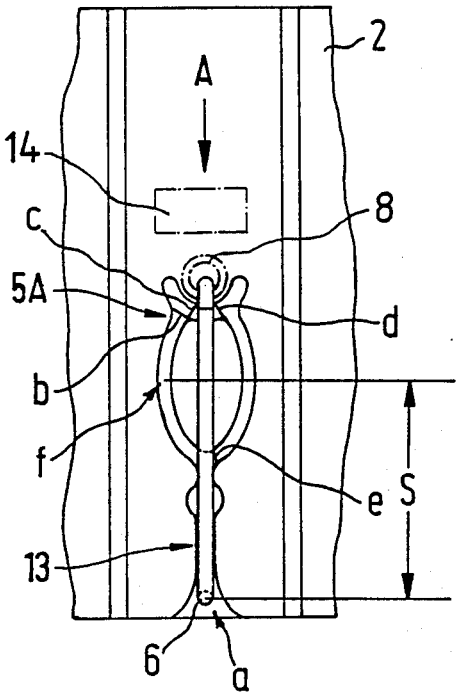
FIG. 2B
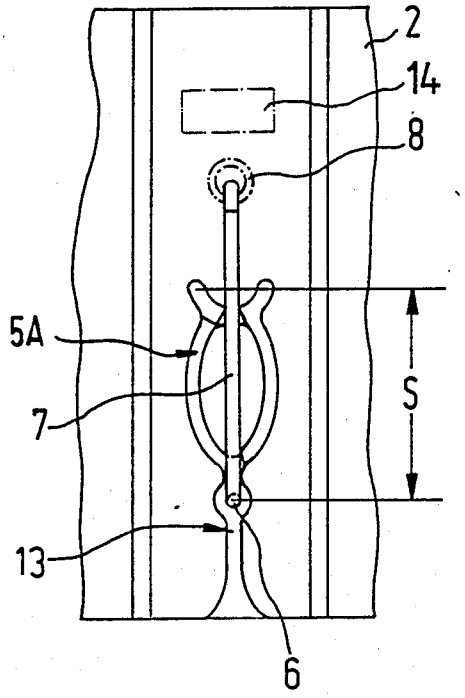
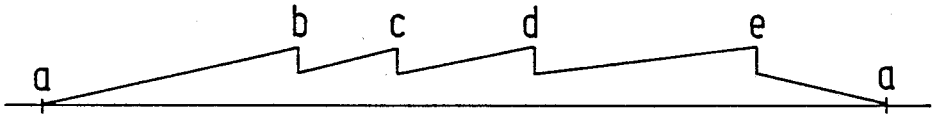
FIG. 3

PUSHBUTTON SWITCH

BACKGROUND OF THE INVENTION

The invention relates to electric switches in general, and more particularly to improvements in so-called pushbutton switches wherein a mobile member (such as a plunger) is depressible from an extended or inoperative position to a depressed or operative position and is normally biased to the extended position. Still more particularly, the invention relates to improvements in convertible pushbutton switches of the type capable of operating as so-called momentary switches or as so-called latching or alternate-action switches. A momentary switch is designed to complete one or more circuits as long as its mobile member remains depressed; however, the circuit or circuits are interrupted as soon as the pressure upon the mobile member is relaxed or terminated. An alternate-action or latching switch operates in such a way that an initial depression of the mobile member results in completion of one or more circuits and such circuit or circuits remain completed when the pressure upon the depressed mobile member is relaxed or terminated. Opening of the circuit or circuits necessitates a renewed (second) depression of the mobile member.

Convertible momentary and latching switches are disclosed, for example, in U.S. Pats. Nos. 4,242,544 and 4,242,545, and in Swiss Pat. No. 595,687. An advantage of such switches is that the manufacturer need not supply two different sets of switches, namely a first set acting only as momentary switches and a second set acting only as latching switches.

The switch which is disclosed in Swiss Pat. No. 595,687 has two cams and a single follower which can be transferred from a first position, in which it cooperates with one of the cams and the switch acts as a momentary switch, to a second position in which the follower cooperates with the other cam and the switch acts as a latching switch. A drawback of such switches is that transfer of the follower from one position to the other position necessitates complete separation of the follower from the remaining parts of the switch. Moreover, the follower and the cam are very small if the switch is a microswitch so that it is difficult to see the momentary position of the follower without a magnifying glass, and the transfer of such minute follower from one to the other position is a tedious and time-consuming operation. The making of two discrete cams contributes to the initial cost of the switch, and the two cams occupy a substantial amount of space. Still further, the follower must be readily accessible for repeated detachment from and for repeated reattachment to other parts of the switch.

OBJECTS OF THE INVENTION

An object of the invention is to provide a convertible pushbutton switch which is constructed and assembled in such a way that it need not employ two discrete cams.

Another object of the invention is to provide the switch with a follower which need not be bodily detached from other parts of the switch when the latter is to be converted from a latching switch into a momentary switch or vice versa.

A further object of the invention is to provide a microswitch which can be converted for operation as a latching switch or as a momentary switch in a time-saving operation and by resorting to rudimentary tools.

An additional object of the invention is to provide a novel and improved plunger for use in the above outlined convertible switch.

Still another object of the invention is to provide a novel and improved cam follower for use in the above outlined switch.

A further object of the invention is to provide a microswitch which, if desired can be permanently converted for operation as a momentary switch or as a latching switch.

An additional object of the invention is to provide a novel and improved carrier for one component of the means for converting the switch from operation as a momentary switch to operation as a latching switch or vice versa.

SUMMARY OF THE INVENTION

The invention is embodied in a pushbutton switch which comprises a preferably tubular housing, a plunger which is movable in the housing in a predetermined direction between an extended (inoperative) and a depressed (operative) position, a carrier which is movable relative to the housing between first and second positions, a cam member, and a follower member which tracks the cam member. One of the two members is provided on the plunger and the other of the two members is provided on the carrier. The cam member includes an arresting portion which is outside of the range of the follower member during movement of the plunger to its depressed position in the first position of the carrier but which is engaged by and holds the follower member (to thereby hold the plunger against movement back to the extended position) in response to movement of the plunger to the depressed position. Thus, the switch acts as momentary switch (i.e., a switch of the type wherein the plunger is invariably free to return to the extended position as soon as the application of force to move it to the depressed position is terminated) in the first position of the carrier, and the switch acts as a latching or alternate-action switch in the second position of the carrier (this means that the plunger can return to the extended position only in response to renewed movement toward the depressed position).

A coil spring or other suitable means is provided to permanently bias the plunger to the extended position.

The cam member preferably comprises a first section which is tracked by the follower member in the first position of the carrier, and a second section which is tracked by the follower member in the second position of the carrier. The second section of the cam member can include a heart cam and the first section can include a straight cam which extends in the direction of movement of the plunger between its extended and depressed positions. The heart cam is configurated in such a way that it permits the plunger to move back to the extended position in response to renewed movement of the plunger toward the depressed position following engagement of the follower member by the arresting portion of the cam member. If the cam member has a cam groove, the arresting portion can include or constitute a tooth in the groove.

The cam member can be provided on the plunger, and the carrier can include a spring (particularly a leaf spring) which is in frictional engagement with the housing. The spring is movable relative to the housing in the direction of movement of the plunger between its extended and depressed positions.

The switch can further comprise means for permanently or releasably locking the carrier to the housing in one of the first and second positions, particularly in the second position. The locking means can comprise male and female detent elements one of which is provided on the housing and the other of which is provided on the carrier. The female detent element can include a socket in the carrier, and the male detent element can comprise a projection which extends into the socket in the one position of the carrier. The latter can be provided with a shoulder or another protuberance to facilitate its movement between first and second positions in response to the application of a suitable tool, e.g., the working end of a screwdriver.

The follower member can be separably coupled to the plunger or to the carrier. It is presently preferred to separably couple the follower member to the carrier and to provide the cam member with a groove which is machined into the plunger.

The novel features which are considered as characteristic of the invention are set forth in particular in the appended claims. The improved switch itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2A is a fragmentary elevational view of the cam and follower member and of adjacent portions of the carrier and plunger, substantially as seen in the direction of arrow II in FIG. 1, the carrier being shown in the first position;

FIG. 2B shows the structure of FIG. 2A but with the carrier in the second position; and FIG. 3 is a diagrammatic developed view of the bottom surface in the groove of the cam member.

DESCRIPTION OF PREFERRED EMBODIMENTS

Figure 1:
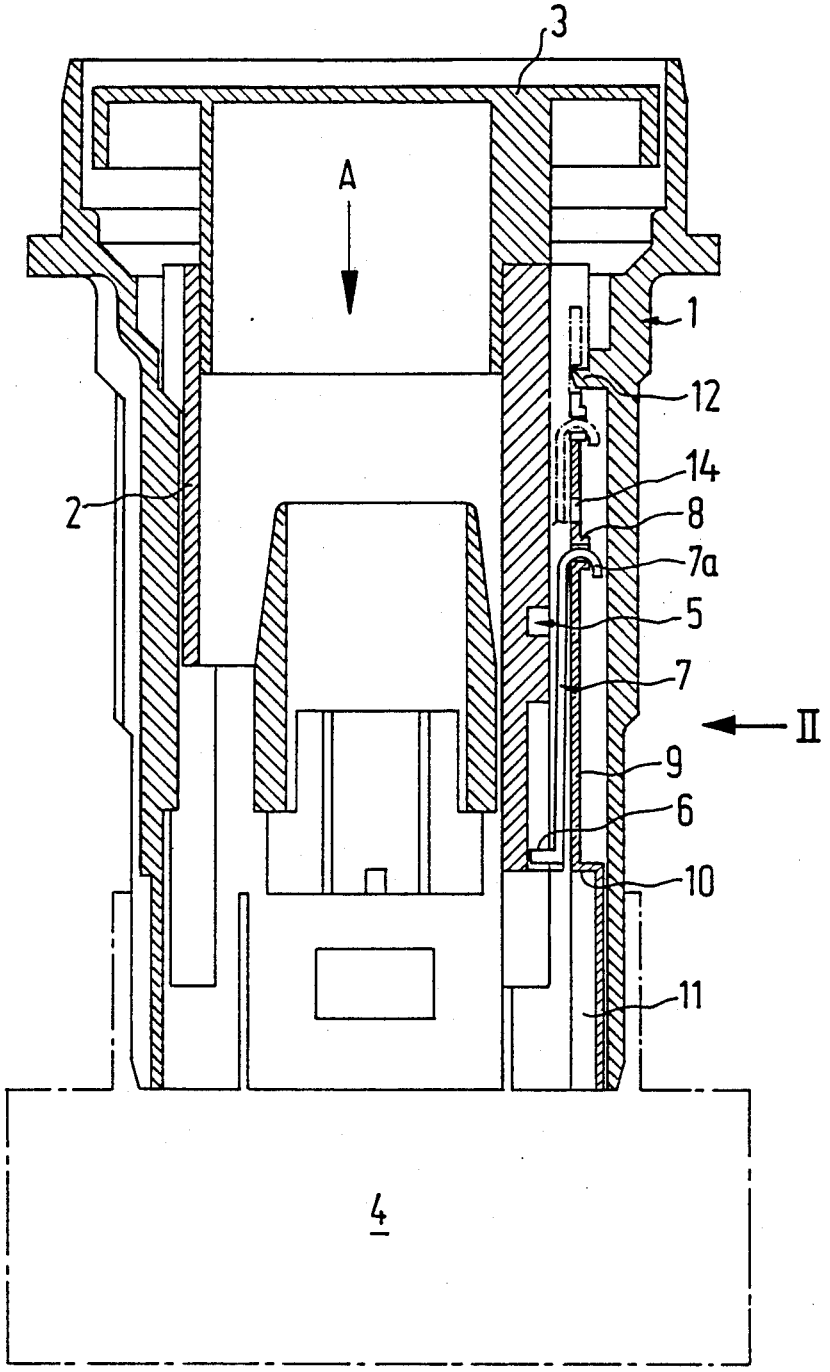
FIG. 1 is is an enlarged partly diagrammatic and partly central longitudinal sectional view of a pushubutton switch which embodies one form of the invention, the first position of the carrier being shown by solid lines and the second position of the carrier being shown by phantom lines.

The pushbutton switch which is shown in FIG. 1 comprises a tubular housing 1 for a reciprocable switching member 2 (hereinafter called plunger) connected with a cap-like support 3 for a depressible knob, not shown. A spring (such as the spring 102 shown in FIG. 2 of U.S. Pat. No. 4,242,545 or the spring 19 shown in U.S. Pat. No. 4,591,712) is provided to bias the plunger 2 to the first or extended (inoperative) position of FIG. 1. A suitable stop (not shown in FIG. 1) is provided in or on the housing 1, or on a part which is connected with the housing, to arrest the plunger 2 in the extended position of FIG. 1, i.e., to prevent movements of the plunger upwardly and beyond the extended position.

That portion of the housing 1 which is remote from the support 3 is connected with a casing 4 for one or more switching elements (e.g., microswitches) which are actuated in response to movement of the plunger 2 to the depressed or operative position (note the arrow A). The exact nature of switching elements in the casing 4 forms no part of the present invention. Reference may be had again to the aforementioned U.S. Pat. No. 4,242,545. The plunger 2 is moved to its depressed position in response to the application of requisite force to the support 3. This support can contain a radiation source which lights up in response to depression of the plunger 2.

The external surface of the plunger 2 is provided with a single cam member 5 which has a specially configurated groove for the radially extending tip 6 of a follower member 7. The latter is separably coupled to an elongated carrier 9 here shown as a leaf spring in frictional engagement with the housing 1. The means for coupling the follower member 7 to the carrier 9 comprises an eyelet 8 on the carrier and a hook-shaped portion **7*a* at that end of the follower member 7 which is remote from the radially inwardly extending tip 6. The follower member 7 can be said to constitute a pendulum which can turn about the axis of the eyelet 8 so that its tip 6 can follow the outlines of surfaces bounding the groove of the cam member 5**.

The carrier 9 is further provided with a shoulder 10 which is engageable by the working end of a screwdriver or another rudimentary tool (not shown) in order to shift the carrier 9 from the solid-line (first) position to the phantom-line (second) position of FIG. 1. The lower portion of the carrier 9 (as seen in FIG. 1) is in frictional engagement with the surface surrounding an axially parallel groove or recess 11 in the internal surface of the housing 1. The person in charge of moving the carrier 9 from the first to the second position must overcome friction between the carrier and the housing 1 in order to move the carrier and the follower member 7 relative to the housing and plunger 2 in a direction toward the support 3. The carrier 9 has a female detent element 14 with a hole or socket which can receive a projection 12 constituting a male detent element and being provided at the inner side of the housing 1. The projection 12 snaps into the socket of the female detent element 14 when the carrier 9 reaches the second position, and the two detent elements then cooperate to preferably (but not necessarily) non-removably lock the carrier 9 in the second position. Shifting of the carrier 9 and follower member 7 relative to the housing 1 entails a movement of the tip 6 of follower member 7 relative to the cam member 5 (it being assumed here that the carrier 9 is shifted to the second position while the plunger 2 remains in the extended position of FIG. 1). The shoulder 10 can be reached by a tool in response to detachment of the casing 4 from the respective end portion of the housing 1. Alternatively, the casing 4 can be provided with a passage for introduction of the tool in order to engage the shoulder 10 and to shift the carrier 9 and follower member 7 to the second positions.

The carrier 9 is preferably inserted in prestressed condition so that it urges the tip 6 of the follower member 7 into the groove of the cam member 5 at the outer side of the plunger 2. The arrangement is such that the tip 6 is urged into contact with the bottom surface of the groove in the cam member 5. The locking means including the detent elements 12 and 14 can be omitted if the frictional engagement between the carrier 9 and the housing 1 is sufficiently pronounced to ensure reliable retention of the carrier in the first or second position. The direction of movement of the carrier 9 relative to the housing 1 is generally parallel to the direction of movement (arrow A) of the plunger 2 from the extended to the depressed position. Absence of the locking means 12, 14 for non-returnably holding the carrier 9 and the follower member 7 in the second positions is desirable if the improved pushbutton switch is to be rapidly converted for operation as a momentary switch or as a latching or alternate-action switch.

As can be seen in FIGS. 2A and 2B, the cam member 5 includes a first section 5A which is basically a heart cam and a second section 13 which has a straight cam groove communicating with the adjacent apex of the groove of the heart cam 5A. The length of the section 13 (in the direction of arrow A) is selected in such a way that the tip 6 of the follower member 7 remains in the section 13 in each position of the plunger 2 when the carrier 9 is maintained in the first position (shown in FIG. 1 by solid lines and also shown in FIG. 2A). The switch then acts as a momentary switch, i.e., the aforementioned spring which biases the plunger 2 to the extended position is free to immediately return the plunger to such extended position as soon as the pressure upon the support 3 is relaxed or reduced sufficiently to enable the spring to return the plunger 2 and the support 3 to the positions of FIG. 1. Moreover, the length of section 13 of the cam member 5 is selected in such a way that the tip 6 of the follower member 7 extends into the groove of this section 13 in the extended position of the plunger 2 irrespective of whether the carrier 9 is maintained in the first position of FIG. 2A or in the second position of FIG. 2B.

The configuration of the bottom surface of the composite groove in the cam member 5 is shown schematically in FIG. 3. The reference character a denotes the lower end of the groove in the section 13 (as seen in FIGS. 2A and 2B), and the bottom surface thereupon slopes toward the carrier 9 between a and an arresting portion b in the form of a tooth-shaped protuberance. The arresting portion b is followed by a second tooth-shaped protuberance c (as seen in the clockwise direction of the section 5A of the cam member 5), thereupon by a protuberance d and a protuberance e whence the bottom surface of the groove slopes back toward a. Thus, the bottom surface of the groove of the cam member 5 slopes outwardly toward the carrier 9 from a to b (where it abruptly recedes in a direction away from the carrier), to again slope toward the carrier between b and c (where it abruptly recedes away from the carrier), to again slope toward the carrier between c and d as well as between d and e (with abrupt recessions at d and e) prior to gradually receding from e to a.

If the carrier 9 is held in the first position of FIG. 2A, the distance S which the plunger 2 covers between the extended and depressed positions is less than the distance from a to the arresting portion b in the bottom surface of the groove in the cam member 5. Thus, when the pressure upon the support 3 is relaxed in fully depressed position of the plunger 2, the aforementioned spring automatically returns the plunger to the extended position of FIG. 1 because the tip 6 of the follower member 7 was unable to engage the shoulder of the arresting portion b. When the plunger 2 reaches the extended position, the tip 6 of the follower member 7 is located at f which is between a and b in the groove of the cam member 5. Thus, and as already explained above, the structure which is shown in FIG. 1 acts as a momentary switch as long as the carrier 9 remains in the first position of FIG. 2A.

If the operator thereupon decides to shift the carrier 9 to the second position by exerting a certain pressure against the shoulder 10, the carrier 9 moves relative to the housing 1 and plunger 2 until the socket of the female detent element 14 receives the projection (male detent element) 12 of the housing 1 to thus lock the carrier 9 and the follower member 7 in the second positions which are shown in FIG. 2B. Depression of the plunger 2 through the distance S then results in a movement of the tip 6 over and beyond the arresting portion b of the cam member 5. Thus, if the pressure upon the support 3 is thereupon relaxed or terminated and the plunger 2 tends to reassume its extended position under the action of the aforementioned spring, the tip 6 is arrested by the portion b of the bottom surface in the groove of the cam member 5 and the plunger 2 remains in an intermediate position between the extended and depressed positions. The switching element or elements in the casing 4 remain actuated in the intermediate position of the plunger 2, i.e., such intermediate position is equivalent to the depressed position and the switch of FIG. 1 then acts as a latching or alternate-action switch because it is necessary to depress the plunger 2 a second time before the plunger can return to the extended position of FIG. 1.

During depression of the plunger 2 from the extended position to the depressed position in the second position (FIG. 2B) of the carrier 9, the tip 6 of the follower member 7 travels in the groove of the left-hand portion of the heart cam 5A and moves beyond the arresting portion b and the protuberance c to be arrested by the follower member 5 against return movement toward the fully extended position. The tip 6 has moved to the right during movement over the portion c during the initial stage of return movement of the plunger 2 in response to first depression and subsequent relaxation or termination of pressure upon the support 3. When the plunger 2 is depressed for the second time, the tip 6 of the follower member 7 (which is stationary) rides over the portions d and e in a clockwise direction (as seen in FIG. 2B) so that the aforementioned spring is free to return the plunger to the fully extended position of FIG. 1.

It will be seen that the improved switch can be rapidly converted from operation as a momentary switch to operation as a latching switch without the need to remove any parts but merely by effecting a movement of the housing 1 and carrier 9 relative to each other. In the absence of locking means 12, 14, the switch can be reconverted to operate as a momentary switch, e.g., by ensuring that the frictional engagement between the carrier 9 and the surface surrounding the recess 11 in the housing 1 suffices to reliably retain the carrier 9 in the first or second position.

With the possible exception of the carrier 9 and follower member 7, all illustrated parts of the improved switch can be made of a plastic material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A pushbutton switch comprising a housing; a plunger movable in said housing in a predetermined direction between extended and depressed positions; a carrier movable relative to said housing in said predetermined direction between first and second positions; a single cam member; and a follower member arranged to track said cam member, one of said members being provided on said plunger and the other of said members being provided on said carrier, said cam member including an arresting portion which is spaced apart from said follower member during movement of said plunger to depressed position in the first position of said carrier but is engaged by and holds said follower member to thereby hold said plunger against movement to said extended position on movement of said carrier to said second position.

2. The switch of claim 1, wherein said housing includes a tube and said plunger is reciprocable in said tube.

3. The switch of claim 1, wherein said cam member has a first section which is tracked by said follower member in said first position of said carrier, and a second section which is tracked by said follower member in the second position of said carrier, said first and second sections being disposed substantially-end-to-end in said predetermined direction.

4. The switch of claim 3, wherein said second section includes a heart cam and said first section extends in said predetermined direction.

5. The switch of claim 4, wherein said heart cam is configurated to permit movement of said plunger back to said extended position in response to renewed movement of the plunger toward said depressed position following engagement of said follower member by said arresting portion.

6. The switch of claim 5, wherein said cam member has a groove and said arresting portion includes a tooth in said groove.

7. The switch of claim 1, wherein said cam member is provided on said plunger and said carrier includes a spring which is in frictional engagement with said housing.

8. The switch of claim 7, wherein said spring is a leaf spring which is movable relative to said housing in said predetermined direction.

9. The switch of claim 1, further comprising means for locking said carrier to said housing in one of said positions.

10. The switch of claim 9, wherein said locking means comprises a male and a female detent element, one of said elements being provided on said housing and the other of said elements being provided on said carrier.

11. The switch of claim 10, wherein said female detent element has a socket in said carrier and said male detent element has a projection which extends into said socket in said one position of said carrier.

12. The switch of claim 11, wherein said locking means is arranged to lock said carrier in said second position.

13. The switch of claim 1, further comprising means for separably coupling said follower member to said carrier.

14. The switch of claim 1, wherein said cam member has a groove in said plunger.

* * * * *